US005196798A

United States Patent [19]

Baeza et al.

[11] Patent Number: 5,196,798

[45] Date of Patent: Mar. 23, 1993

[54] AUTOMOTIVE IGNITION COIL TESTER

[76] Inventors: Pedro Baeza; Michael Baeza, both of 2734 Rosarita St., San Bernardino, Calif. 92407

[21] Appl. No.: 716,497

[22] Filed: Jun. 17, 1991

[51] Int. Cl.[5] ..... F02P 17/00

[52] U.S. Cl. ..... 324/388; 324/393

[58] Field of Search ..... 324/393, 388, 390, 380; 73/116, 118.1

[56] References Cited

U.S. PATENT DOCUMENTS

| | | | |
|---|---|---|---|
| 1,998,405 | 4/1935 | Fernandez | 324/388 |
| 3,354,387 | 11/1967 | Whaley et al. | 324/388 |
| 4,937,527 | 6/1990 | Sniegowski et al. | 324/393 |

FOREIGN PATENT DOCUMENTS

| | | | |
|---|---|---|---|
| 2533570 | 2/1977 | Fed. Rep. of Germany | 324/380 |
| 2807116 | 8/1979 | Fed. Rep. of Germany | 324/393 |

*Primary Examiner*—Jack B. Harvey
*Assistant Examiner*—Maura K. Regan
*Attorney, Agent, or Firm*—John J. Posta, Jr.

[57] ABSTRACT

A device for testing ignition coils from automobile and other spark ignition engines is disclosed which is a small, handheld ignition coil tester powered by the battery of the engine's ignition system. The coil tester provides a visual indication of proper high voltage pulse generation or, in the case of improper function of the ignition coil caused by a short in the ignition coil, provides an indication of the existence of the short in the ignition coil. The coil tester includes a spark gap module which has vacuum sealed electrodes to provide an excellent visual indication of proper coil operation.

17 Claims, 3 Drawing Sheets

AUTOMOTIVE IGNITION COIL TESTER

BACKGROUND OF THE INVENTION

Field of the Invention

The present invention relates generally to a device for testing ignition coils from automobile and other spark ignition engines, and more particularly to a small, handheld ignition coil tester which is powered by the battery of the engine's ignition system, and which provides a visual indication of proper high voltage pulse generation or, in the case of improper function of the ignition coil caused by a short in the ignition coil, provides an indication of the existence of the short in the ignition coil.

Spark ignition systems are used extensively in most small and intermediate size engines, such as those used in automotive applications. A spark ignition system is used to provide a spark in the cylinders of both two and four cycle engines to ignite the compressed air-fuel mixture to drive the pistons (or, in the case of a rotary engine, the rotors). The ignition system uses a battery and a generator to supply electrical power to the system, and a distributor having points or a breakerless impulse generation system, which together are used to supply ignition pulses to spark plugs located in each of the cylinders. The heart of the ignition system is the ignition coil, which is located between the power supply and the distributor. The ignition coil converts the low voltage of the power supply (the battery) to the high voltage pulses supplied by the distributor to the spark plugs.

The coil is essentially a transformer, with a primary winding and a secondary winding mounted on a common magnetic circuit with an air gap. One side of each of the primary and secondary windings are typically connected together, with the other sides of the primary and secondary windings being used for the low voltage input to the coil and the high voltage output from the coil, respectively. The primary to secondary turns ratio is typically 1:60 to 1:110, with the secondary typically having approximately 15,000 to 30,000 turns of 40- or 42-gage enameled wire. Typical primary resistance is 3.5 to 7 Ohms (a lower resistance is used in some coils which require an external resistor to operate properly), and typical primary inductance is approximately 8 to 20 mH.

For purposes of the discussion herein, the use of an ignition system having points will initially be assumed. The points are periodically opened and closed by rotation of the distributor shaft. The points are normally closed, supplying low voltage from the power supply to the primary winding in the coil. When a spark is to be produced, the points will be opened for a brief interval, with the sudden decay of flux in the primary winding of the coil producing a high voltage pulse from the secondary winding in the coil. The high voltage pulse is supplied by the distributor to the proper spark plug, producing a spark in the cylinder and initiating ignition of the compressed air-fuel mixture.

In a breakerless ignition system, an inductive or optical pickup is used instead of points. As the distributor rotates, electrical pulses are periodically generated by the pickup. The pulses are supplied to an amplifier, which generates an output signal which is used to drive the primary winding of the coil. Each time pulses from the pickup cause the amplifier to generate a low voltage pulse in the primary winding of the coil, a high voltage pulse is supplied from the secondary winding in the coil. The high voltage pulse is then supplied by the distributor to a spark plug, producing a spark in the cylinder and initiating ignition of the compressed air-fuel mixture.

It is thus apparent that the coil is the heart of the ignition system, and if it fails, the engine will be inoperative. It has thus been desirable to have some mechanism for testing a coil to determine whether or not it is good or defective. While an Ohmmeter may be used with limited success to check a coil to see whether it is defective, an Ohmmeter does not test a coil under actual operating conditions.

As might be expected, the art contains a number of references which to a lesser or greater extent address this problem. U.S. Pat. No. 2,249,157, to Morgan et al., U.S. Pat. No. 3,354,387, to Whaley et al., and U.S. Pat. No. 4,186,337, to Volk et al. are three such references. The Morgan et al. patent uses a large device with electrical circuitry to supply pulses to a coil and to analyze the output. Unfortunately, the Morgan et al. device does not provide a direct indication of the production of a spark by the secondary winding of the coil. Rather, the Morgan et al. device uses a complex (and bulky) electrical apparatus to determine whether the secondary coil has produced a proper output. A direct indication of this output is very much preferable, and the size and cost (due to its complexity) makes the Morgan et al. device interesting but not a complete solution to the problem.

The Whaley et al. patent is an improvement in that it is smaller, and it provides a more direct indication of proper coil operation. However, it uses an annular spark electrode in conjunction with another annular member somehow used as an electrode. The construction of these members is far from close to conducive to the generation of a spark, and their effectiveness may be somewhat less then optimal. In addition, the Whaley et al. device requires internal batteries, which increases the size and weight of the device.

The Volk et al. patent is further from the point, with a plurality of devices being required. The Volk et al. device also puts a spark indicator in series with the normal output pulse components, possibly inhibiting a spark from a normal coil due to the additional impedance of double spark gaps. The Volk et al. device also has far from optimal spark gap design, with spaced-apart cables being used as electrodes.

Other references of interest include U.S. Pat. No. 4,331,921, to Walker, which discloses a circuit for detecting an interruption of primary current caused by other ignition system problems; U.S. Pat. No. 4,401,948, to Miura et al., which discloses a system measuring the rise of secondary coil output voltage to determine stray capacitance in the ignition system; and U.S. Pat. No. 4,449,100, to Johnson et al., which discloses a device which evaluates the integral of secondary voltage over time. These devices are complex, for the most part expensive, and are not designed to determine whether a coil is functioning properly or not.

It is accordingly the primary objective of the present invention that it provide a small, inexpensive device which is capable of testing an ignition coil to determine whether or not it is functioning properly. The testing device must be easy to use, and it must provide direct connections to an automotive type coil so that it may be tested. The testing device should be operable using electrical power from an automotive battery rather than requiring internal batteries in the device, thus minimizing the size and weight of the testing device.

The testing device must include a signal generator to provide test signals to the primary winding in the coil, and visible means for indicating whether or not the coil being tested is in fact generating a high voltage output pulse from the secondary winding in response to the low voltage input signals being supplied to the primary winding. The visible indicating means must accurately simulate the spark gap in a spark plug, both to allow the operator of the coil tester to observe whether proper coil operation is occurring or not, and further to ensure that the device provides an electrically accurate analogy of the operation of a spark plug. It is a further objective that the coil tester provide an additional indication to confirm improper coil operation if the coil has an internal short.

It is an additional objective of the present invention that a tester be provided which is operable with all types of automotive coils, including those which require an external resistance to operate, and those that operate without such an external resistance. The improved tester of the present invention must also be of inexpensive construction to ensure it the broadest possible economic marketing advantage, and it must operate accurately and effectively over a long life achieved through durable construction. Finally, it is also an objective that all of the aforesaid advantages and objectives of the present invention be achieved without incurring any substantial relative disadvantage.

SUMMARY OF THE INVENTION

The disadvantages and limitations of the background art discussed above are overcome by the present invention. With this invention, a highly compact, portable coil tester is provided for testing an ignition coil such as those used in automotive applications. The coil tester of the present invention is approximately the size of a handheld calculator, with four wires with alligator clips on the free ends thereof extending from the side of the device. Two of the wires are for connection to an automobile battery as the power source for the coil tester, with the other two wires for connection to the common or ground terminal and the primary connection terminal of a coil.

The coil tester has an additional high voltage input connector similar to the connector on the top of a spark plug which is for connection to the ignition wire from the secondary output of the coil. The end of this ignition wire connected to the center terminal of a distributor cap would be removed from the distributor cap, and connected to the high voltage input connector on the coil tester.

The coil tester of the preferred embodiment includes a pulse generation circuit which is operated by actuating a button located on top of the coil tester. The pulse generation circuit produces low voltage pulses, which are supplied to the primary winding of the coil. If the coil is operating properly, the secondary winding of the coil will produce high voltage pulses, which will generate a highly visible spark on a directly viewable spark gap also located on top of the coil tester.

If the coil is not operating properly, of course, sparks will not be visible. The coil tester also includes circuitry which in this event will light an indicator lamp located on top of the coil tester if the problem with the coil is the existence of a short in the coil. The coil tester may optionally include additional output apparatus, such as a buzzer to indicate improper operation of the device, if desired.

The coil tester of the present invention also includes a switch located on top of the coil tester and a resistor inside the coil tester. The switch is used to selectively include the resistor in the input circuit to the primary winding if the coil being tested requires an external resistor to operate properly. Thus, the coil tester of the present invention will operate with a coil of either type.

The coil tester of the present invention uses a spark gap module, the electrical characteristics of which closely resemble the electrical characteristics of a spark plug in an engine. The actual spark gap is created between a pair of needle-shaped electrodes, which provide a spark which is significantly more visible than the visible indication provided in any of the previously known coil analyzer devices. The electrodes are preferably located in a sealed module, which will greatly extend their operating life.

It may therefore be seen that the present invention teaches a small, inexpensive coil testing device which is capable of accurately testing an ignition coil to determine whether or not it is functioning properly. The coil testing device is easy to use, and it provides alligator clips for making direct connections to an automotive type coil so that it may be tested. The coil testing device is operable using electrical power from an automotive battery rather than requiring internal batteries in the device, thereby minimizing the size and weight of the testing device.

The testing device includes a signal generator to provide test signals to the primary winding in the coil, and visible means to indicate whether or not the coil being tested is in fact generating a high voltage output pulse from the secondary winding in response to the low voltage input signals supplied to the primary winding. The visible indicating means accurately simulates the spark gap in a spark plug, allowing the operator of the coil tester to observe whether or not proper coil operation is occurring, and further ensuring that the device provide an electrically accurate analogy of the operation of a spark plug. The coil tester further provides an indication confirming improper coil operation if the coil has an internal short.

The coil tester of the present invention is operable with all types of automotive coils, including both those which require an external resistance to operate, and those which operate without such an external resistance. The improved tester of the present invention is also of inexpensive construction, thereby ensuring it the broadest possible economic marketing advantage. It will thereby operate accurately and effectively over a long life achieved through its durable construction. Finally, all of the aforesaid advantages and objectives of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
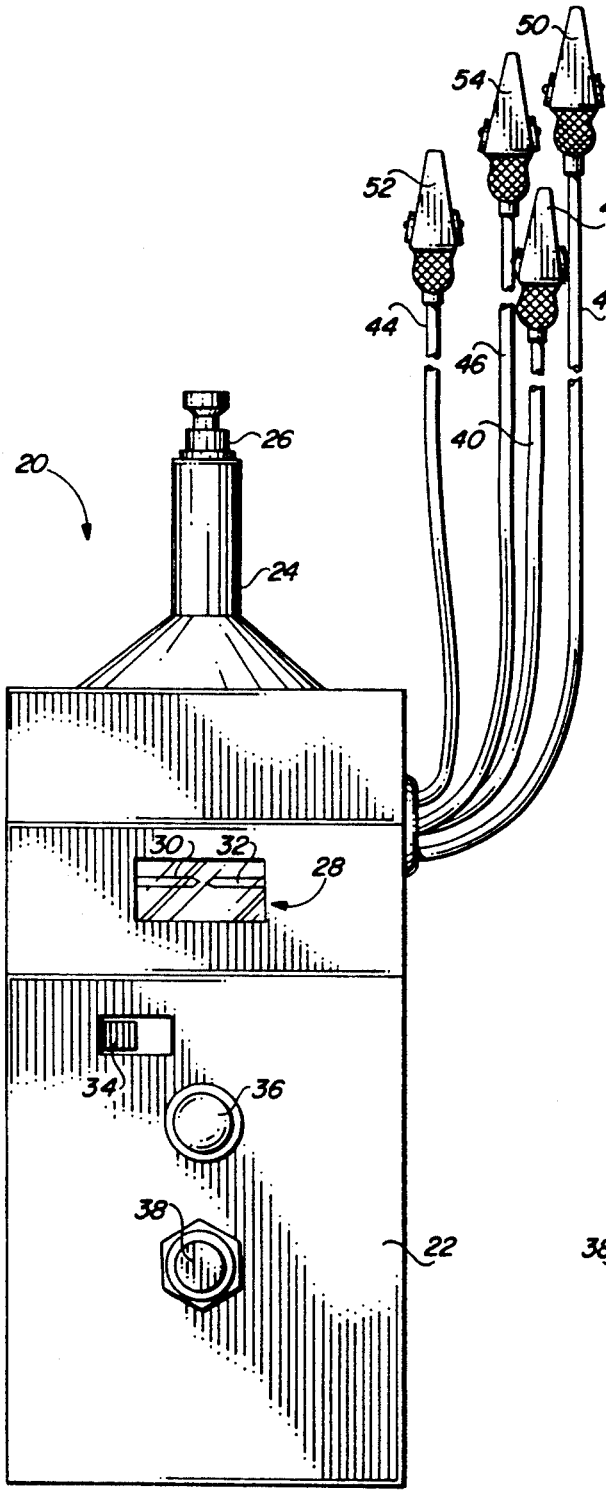
FIG. 1 is a top plan view of the coil tester of the present invention, showing the spark gap as viewed through a viewing window, the switch used to optionally supply an external resistance to those coils requiring such a resistance to operate, an indicator lamp to identify the existence of a short in a coil being tested, and the button used to operate the coil tester, as well as the alligator clips used to connect the coil tester to a battery and to the coil.
Figure 2:
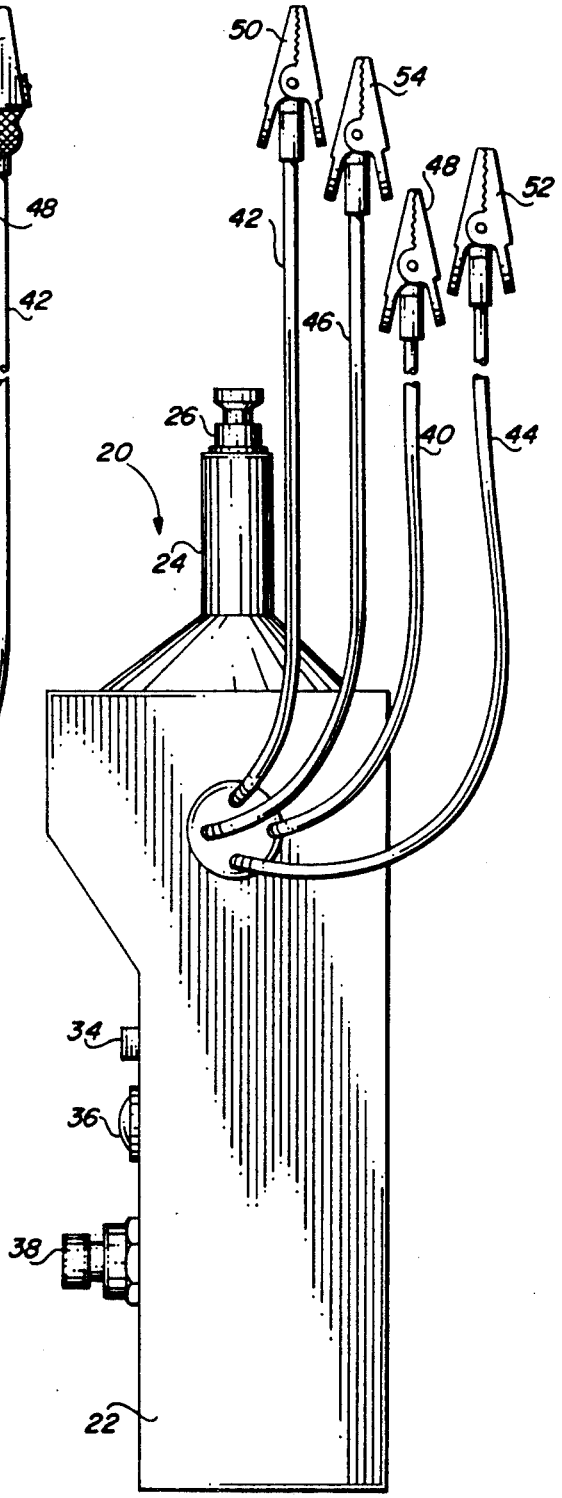
FIG. 2 is a side view of the coil tester shown in FIG. 1.

The preferred embodiment of the present invention is illustrated in FIGS. 1 and 2, which show a coil tester 20 which is approximately the size of a handheld calculator. The coil tester 20 includes a variety of components mounted in a housing 22, which in the exemplary embodiment illustrated is approximately 5 inches long, by 2.625 inches wide, by 2 inches thick. Extending from one end of the housing 22 of the coil tester 20 is a funnel-shaped extension 24, on which is mounted a high voltage input connector 26.

The portion of the high voltage input connector 26 which extends from the funnel-shaped extension 24 is of the size and configuration of a standard type spark plug connector tip. Thus, it will be appreciated by those skilled in the art that the end of the ignition wire between the secondary output of the coil (not shown) and the center terminal of the distributor cap (also not shown) may be removed from the distributor cap, and connected to the high voltage input connector 26 on the coil tester 20. Alternately, any wire having a connector at one end fitting in the high voltage output from the coil and a spark plug connector at the other end may be used. The funnel-shaped extension 24 it typically manufactured in integral fashion with the housing 22 of the coil tester 20, of an insulating material such as plastic.

Mounted in the top of the housing 22 of the coil tester 20 are a variety of components. The visual indicator of the coil tester 20 which is used to show proper operation of a coil being tested is a spark gap module 28, which is mounted at a convenient viewing angle in the top of the housing 22 of the coil tester 20. Visible in the spark gap module 28 are a first electrode 30 and a second electrode 32, which are separated by a spark gap. The spark gap module 28 will be further discussed below in conjunction with FIGS. 4 through 6.

Also mounted in the top of the housing 22 of the coil tester 20 is a external resistance switch 34 having two positions. In one position, the external resistance switch 34 is used to switch into the drive circuit used to supply signals to the primary winding of a coil (not shown here) an external series resistance (contained within the housing 22 of the coil tester 20) for testing coils requiring such an external resistance to operate. In the other position, the external resistance switch 34 bypasses this external resistance and supplies signals directly to the primary winding.

An indicator lamp 36 is also mounted in the top of the housing 22 of the coil tester 20. The indicator lamp 36 is used to identify the existence of a short in a coil (not shown here) being tested. When the coil tester 20 is being used, if the indicator lamp 36 lights, then there is a short in the coil. The last component mounted in the top of the housing 22 of the coil tester 20 is an operating button 38 used to operate the coil tester 20. When the operating button 38 is pressed, the coil tester 20 will test a coil (not shown here) connected to the coil tester 20.

Extending from the side of the coil tester 20 are four wires 40, 42, 44, and 46. At the free ends of the wires 40, 42, 44, and 46 extending from the side of the coil tester 20 are four alligator clips 48, 50, 52, and 54, respectively. The two larger alligator clips 48 and 50 are for respective connection to the positive and negative terminals of an automobile battery (not shown) as the power source for the coil tester 20. The two smaller alligator clips 52 and 54 are for respective connection to the common or ground terminal of a coil (not shown here) and to the primary winding connection terminal of a coil (also not shown here).

Figure 3:
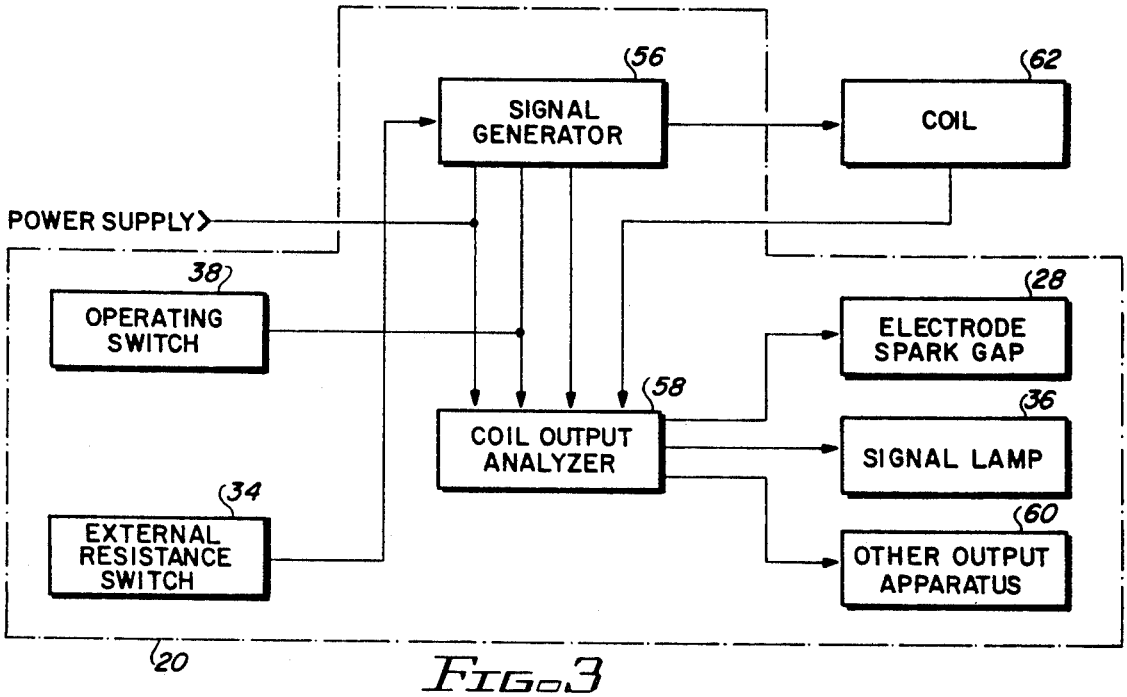
FIG. 3 is a functional schematic block diagram illustrating the operation of the coil tester shown in FIGS. 1 and 2.

Referring next to FIG. 3, a block diagram illustrates in schematic form the operation of the coil tester 20. Several components are those included on the top of the housing 22 of the coil tester 20 (FIG. 1). These components include the spark gap module 28, the external resistance switch 34, the indicator lamp 36, and the operating button 38. Additional components in the coil tester 20 include a signal generator 56, a coil output analyzer 58, and other output apparatus 60.

An external power supply, which is in the preferred embodiment a car battery, is connected to supply power to the signal generator 56 and the coil output analyzer 58. The connection used would of course be the wires 40 and 42, which are connected by the alligator clips 48 and 50, respectively (FIGS. 1 and 2), to the positive and negative terminals of the power supply (the car battery), respectively.

The external resistance switch 34 is used to select whether or not the coil to be checked requires an external resistor; if an external resistor is required, the external resistance switch 34 switches one contained in the signal generator 56 into the circuit. The operating button 38 is also connected to both the signal generator 56 and the coil output analyzer 58, to turn both on when the operating button 38 is actuated.

The output of the signal generator 56 is connected to a coil 62 to be tested. The connection would be the wires 44 and 46 which are connected by the alligator clips 52 and 54, respectively (FIGS. 1 and 2), to the common or ground terminal of the coil 62 and to the primary winding connection terminal of the coil 62. The high voltage output of the coil 62 would be supplied as an input to the coil output analyzer 58, via the high voltage input connector 26 (FIGS. 1 and 2). In the preferred embodiment, the high voltage output of the coil 62 may be supplied by the coil output analyzer 58 directly to the spark gap module 28.

When the operating button 38 is pressed, the signal generator 56 will supply a waveform to the primary winding of the coil 62. This waveform will typically be a square wave, which will trigger a series of high voltage outputs if the coil 62 is operating properly. The series of high voltage outputs are supplied to the coil output analyzer 58. If proper high voltage outputs are supplied by the coil 62, they will be provided by the coil output analyzer 58 to the spark gap module 28, where a series of visible sparks will be seen.

If the coil 62 is not operating properly, the coil output analyzer 58 will check the coil 62 for shorts. This is accomplished by an analysis of the coil 62 through the electrical connections between the signal generator 56, which is electrically connected to the coil 62, and the coil output analyzer 58. If a short in the coil 62 is detected, the coil output analyzer 58 will cause the indicator lamp 36 to light to indicate the presence of the short in the coil 62. Optionally, the other output apparatus 60 may be used in conjunction with or instead of the indicator lamp 36. The other output apparatus 60 may be, for example, a buzzer located in the housing 22 of the coil tester 20 (FIGS. 1 and 2).

Figure 4:
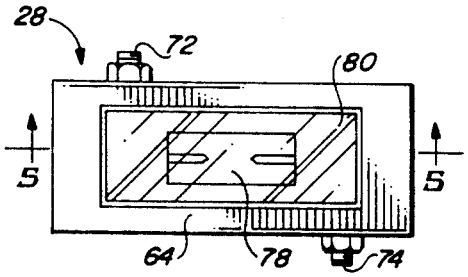
FIG. 4 is a top plan view of the spark gap module used in the coil tester shown in FIGS. 1 and 2.
Figure 6:
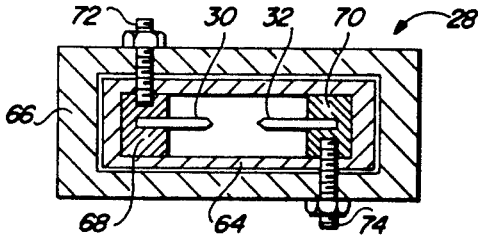
FIG. 6 is a second cutaway view of the spark gap module shown in FIGS. 4 and 5.
Figure 5:
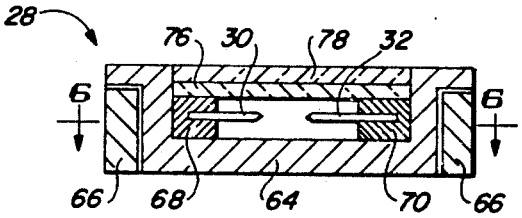
FIG. 5 is a first cutaway view of the spark gap module shown in FIG. 4.

The spark gap module 28 is illustrated in detail in FIGS. 4 through 6. A housing 64 made of non-electrically conductive, non-air permeable material defines a base and sides with outwardly extending flanges at the top edges thereof. Surrounding the four sides of the housing 64 is a plastic side wall portion 66 made of high temperature plastic to serve as an insulator.

Located inside the housing 64 at one end thereof is a first copper block 68; at the other end inside the housing 64 is a second copper block 70. The first electrode 30 extends from the first copper block 68, and the second electrode 32 extends from the second copper block 70. The first and second electrodes 30 and 32 both are needle-like, and have relatively sharp points on their adjacent ends, and are spaced apart to form a spark gap.

A first conductive threaded rod 72 extends from the first copper block 68 and sealingly through the side walls of the housing 64 and the plastic side wall portion 66. A second conductive threaded rod 74 extends from the second copper block 70 and sealingly through the side walls of the housing 64 and the plastic side wall portion 66. A glass top 76 is placed on top of the first and second copper blocks 68 and 70, to seal the enclosure containing the first and second electrodes 30 and 32 with a vacuum inside.

A cover glass 78 having a mask 80 thereon is placed over the top of the glass top 76. The mask 80 defines a small clear viewing area around the spark gap between the first and second electrodes 30 and 32. Thus, the spark gap module 28 encloses the first and second electrodes 30 and 32 in a vacuum, with a small highly visible viewing area being provided to see sparks generated by the coil 62 (FIG. 3). The spark gap module 28 is a vast improvement over the art, and makes it easy to view whether or not the coil 62 is functioning properly.

Figure 7:
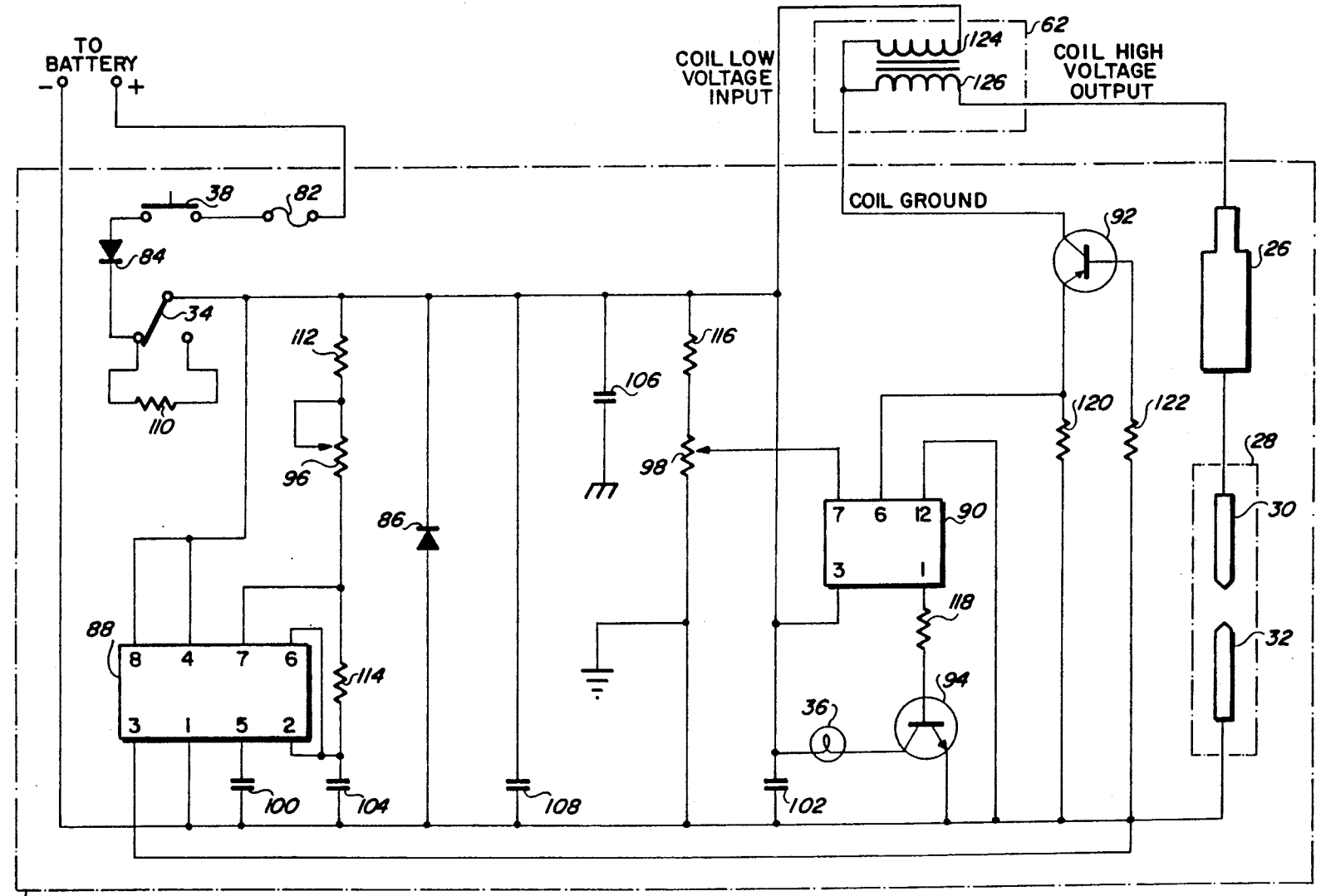
FIG. 7 is an electrical schematic diagram of one possible circuit for performing the functions of the schematic block diagram of FIG. 3.

Referring now to FIG. 7, one possible electrical schematic for a circuit to implement the system schematically described in FIG. 3 is shown. Of the components previously described, the operating button 38 is a single-pole, single-throw (SPST) momentary contact 2 Amp switch to prevent long operation of the coil tester 20. The external resistance switch 34 is a single-pole, double-throw (SPDT) 2 Amp switch. The indicator lamp 36 is a 12 V, 1 Amp lamp.

In addition to the components previously described, a number of other components are used. A fuse 82 has a 5 Amp rating. A diode 84 is a 1N5400, 3 Amp, PIV diode. A diode 86 is a 1N4003, 1 Amp, 200 PIV diode. A first integrated circuit 88 is an LM555 timer. A second integrated circuit 90 is an LM339 quad comparator.

A first transistor 92 is a TIP58A NPN high voltage transistor. A second transistor 94 is a TIP42 PNP transistor. A first potentiometer 96 is a 100 K Ohm, 1/8 Watt miniature PC potentiometer. A second potentiometer 98 is a 1 K Ohm, 1/8 Watt miniature PC potentiometer. A capacitor 100 and a capacitor 102 are both 0.01 microFarad, 50 V capacitors. A capacitor 104 is a 0.1 microFarad, 50 V capacitor. A capacitor 106 is a 0.22 microFarad, 50 V capacitor. A capacitor 108 is a 1000 microFarad, 50 V capacitor.

A resistor 110 is a 0.56 Ohm, 5 Watt resistor. A resistor 112 is a 680 Ohm, ½ Watt resistor. A resistor 114 is a 3.3 K Ohm, ¼ Watt resistor. A resistor 116 is a 4.7 K Ohm, ¼ Watt resistor. A resistor 118 is a 470 Ohm, ½ Watt resistor. A resistor 120 is a 0.56 Ohm, 2 Watt resistor. A resistor 122 is a 150 Ohm, ½ Watt resistor.

The coil 62 as illustrated has a primary coil 124 and a secondary coil 126. All electrical connections are as illustrated in FIG. 7. It will, of course, be appreciated by those skilled in the art that the circuit illustrated in FIG. 7 is but one of many possible implementations. The circuit of FIG. 7 is thus exemplary only, and is not intended to be limiting in any way.

The first integrated circuit 88 acts as an astable multivibrator. The first potentiometer 96 determines the pulse repetition frequency of the square wave appearing at pin 3 of the first integrated circuit 88, which controls the current going to the coil 62 by driving the first transistor 92 through the current limiting resistor 122. The first transistor 92 thus acts as a chopper, delivering a series of square waves to the primary winding 124 of the coil 62. With the values listed, the square wave will have an amplitude of 11.2 V, a 1.066 millisecond on time, and a 0.1370 millisecond off time.

The second integrated circuit 90 is a voltage comparator used to sense a short circuit in the coil 62. The second potentiometer 98 is used to set the level at which the second integrated circuit 90 is triggered. A voltage rise is sensed at the resistor 120, which causes pin 1 of the second integrated circuit 90 to go high. This drives the second transistor 94, which operates the indicator lamp 36 to indicate the presence of a short. The diodes 84 and 86, and the capacitors 102 and 108 ar used to protect the coil tester 20 from noise or spikes.

It may therefore be appreciated from the above detailed description of the preferred embodiment of the present invention that it teaches a small, inexpensive coil testing device which is capable of accurately testing an ignition coil to determine whether or not it is functioning properly. The coil testing device is easy to use, and it provides alligator clips for making direct connections to an automotive type coil so that it may be tested. The coil testing device is operable using electrical power from an automotive battery rather than requiring internal batteries in the device, thereby minimizing the size and weight of the testing device.

The testing device includes a signal generator to provide test signals to the primary winding in the coil, and visible means to indicate whether or not the coil being tested is in fact generating a high voltage output pulse from the secondary winding in response to the low voltage input signals supplied to the primary winding. The visible indicating means accurately simulates the spark gap in a spark plug, allowing the operator of the coil tester to observe whether or not proper coil operation is occurring, and further ensuring that the device provide an electrically accurate analogy of the operation of a spark plug. The coil tester further provides an indication confirming improper coil operation if the coil has an internal short.

The coil tester of the present invention is operable with all types of automotive coils, including both those which require an external resistance to operate, and those which operate without such an external resistance. The improved tester of the present invention is also of inexpensive construction, thereby ensuring it the broadest possible economic marketing advantage. It will thereby operate accurately and effectively over a long life achieved through its durable construction. Finally, all of the aforesaid advantages and objectives of the present invention are achieved without incurring any substantial relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A device for testing an automotive ignition coil having a primary winding and a secondary winding, said device comprising:

a small, compact housing suitable for holding in the hand of a user;

a first pair of wires extending from said housing, said first pair of wires for making an electrical connection to an automobile battery to supply power to said device;

a second pair of wires extending from said housing, said second pair of wires for making an electrical connection to the primary winding of the coil;

a high voltage input connector mounted on said housing for electrical connection to the secondary winding of the coil;

generating/detecting means for generating an electrical output signal to drive the primary winding of the coil and for detecting at least one electrical characteristic of the coil, said generating/detecting means being electrically connected to said first and second pairs of wires, said generating/detecting means being mounted in said housing;

a first switch mounted in said housing for actuating said generating/detecting means when said first switch is actuated;

a sealed spark gap mounted in said housing and electrically connected to said high voltage input connector, said sealed spark gap displaying a spark when said first switch is actuated if the coil if operating properly;

a signal lamp mounted in said housing and electrically connected to said generating/detecting means, said signal lamp for illumination when said first switch is actuated if said one electrical characteristic of the coil is detected;

a resistor for use with a coil requiring an external resistance for proper operation; and a second switch for selectively, alternatively either electrically connecting said resistor to the coil if the coil requires an external resistance for proper operation, or electrically disconnecting said resistor from the coil if the coil does not require an external resistance for proper operation, said second switch being mounted in said housing.

2. A device as defined in claim 1, wherein said housing comprises:

a main housing member, said first and second pair of wires extending from said main housing member, said generating/detecting means being located in said main housing member, and said first switch, said sealed spark gap, and said signal lamp being mounted in the top of said main housing member; and a funnel-shaped extension extending from one end of said main housing member, said high voltage input connector being mounted in the end of said funnel-shaped extension.

3. A device as defined in claim 1, additionally comprising:

means mounted on the free ends of each of said first pair of wires for making electrical connections to the automobile battery; and means mounted on the free ends of each of said second pair of wires for making electrical connections to the primary winding of the coil.

4. A device as defined in claim 3, wherein said means mounted on the free ends of each of said first pair of wires for making electrical connections to the automobile battery comprise larger alligator clips, and wherein said means mounted on the free ends of each of said second pair of wires for making electrical connections to the primary winding of the coil comprise smaller alligator clips.

5. A device as defined in claim 1, wherein said high voltage input connector is of the same type as a spark plug terminal.

6. A device as defined in claim 1, wherein said generating/detecting means comprises:

means for generating said electrical output signal to drive the primary winding of the coil when said first switch mounted in said housing is actuated; and means for detecting the presence or absence of said at least one electrical characteristic of the coil, said detecting means providing an output signal for illuminating said signal lamp if said one electrical characteristic of the coil is present.

7. A device as defined in claim 1, wherein said electrical signal comprises:

a square wave voltage signal.

8. A device as defined in claim 7, wherein said square wave voltage signal has an amplitude of approximately 11.2 V, an on time of approximately 1.066 milliseconds, and an off time of approximately 0.1370 milliseconds.

9. A device as defined in claim 1, wherein said first switch is a momentary contact switch.

10. A device as defined in claim 1, wherein said spark gap comprises:

a housing member made of nonconductive material and having an open top;

a first electrode;

means for mounting said first electrode in said housing member at one end thereof;

a second electrode;

means for mounting said second electrode in said housing member at the other end thereof; and clear means for sealing the top of said housing member.

11. A device as defined in claim 10, wherein said means for mounting said first electrode comprises:

a first copper block located in said housing member at said one end thereof, said first electrode extending from said first copper block toward said other end of said housing member;

and wherein said means for mounting said second electrode comprises:

a second copper block located in said housing member at said other end thereof, said second electrode extending from said second copper block toward said one end of said housing member.

12. A device as defined in claim 11, additionally comprising:

a first conductive threaded rod extending from said first copper block through said housing member in sealing fashion; and a second conductive threaded rod extending from said second copper block through said housing member in sealing fashion.

13. A device as defined in claim 10, wherein said first and second electrodes are needle-like, have relatively sharp points on their adjacent ends, and are spaced apart to form a spark gap.

14. A device as defined in claim 10, wherein the interior of said housing member containing said first and second electrodes is sealed by said clear sealing means with a vacuum therein.

15. A device as defined in claim 1, wherein said at least one electrical characteristic comprises:

the existence of a short in the coil.

16. A device as defined in claim 1, additionally comprising:

additional output apparatus mounted in said housing and electrically connected to said generating-/detecting means, said additional output apparatus for operation when said first switch is actuated if said one electrical characteristic of the coil is detected.

17. A device as defined in claim 1, wherein said additional output apparatus comprises:

means for providing an audible signal when said first switch is actuated if said one electrical characteristic of the coil is detected.

* * * * *